US006691386B2

(12) United States Patent
Marlow

(10) Patent No.: US 6,691,386 B2
(45) Date of Patent: Feb. 17, 2004

(54) ONE-STEP ROTARY FORMING OF UNIFORM EXPANDED MESH

(75) Inventor: John V. Marlow, Oakville (CA)

(73) Assignee: Teck Cominco Metals Ltd., Vancouver (CA)

( * ) Notice: Subject to any disclaimer, the term of this patent is extended or adjusted under 35 U.S.C. 154(b) by 0 days.

(21) Appl. No.: 10/096,873

(22) Filed: Mar. 14, 2002

(65) Prior Publication Data

US 2003/0172507 A1 Sep. 18, 2003

(51) Int. Cl.[7] ..... B21D 32/02; B21D 31/04; B23P 15/16

(52) U.S. Cl. ..... 29/6.2; 29/6.1; 29/896.6

(58) Field of Search ..... 29/6.1, 6.2, 896.6, 29/623.1, 730, 731; 72/185, 186, 203

(56) References Cited

U.S. PATENT DOCUMENTS 5,239,735 A * 8/1993 Tanaka et al. ..... 29/6.1
6,526,637 B1 * 3/2003 Geissler ..... 29/6.1

FOREIGN PATENT DOCUMENTS

EP 0 904 870 3/1999

* cited by examiner

*Primary Examiner*—John C. Hong
(74) *Attorney, Agent, or Firm*—Arne I. Fors

(57) ABSTRACT

A single step method and apparatus for the production of expanded metal mesh from deformable metal strip such as lead or lead-alloy strip for use in lead-acid battery manufacture. The apparatus comprises a pair of opposed rolls each having a plurality of spaced discs having opposite side walls and circumferential, equally spaced, convexly shaped tool surfaces alternating with substantially flat surfaces, said discs having radial notches formed in the opposite sidewalls of alternate circumferential flat surfaces, whereby peripheral surfaces of opposing rolls are adapted to interact on deformable strip passing therebetween to concurrently slit and form convex wire segments and alternate nodes in said strip by intermeshing of said shaped tool surfaces. The method includes concurrently slitting and forming transverse rows of elongated, convexly-shaped wire segments deformed out of the plane of the strip with laterally adjacent wire segments extending from opposite sides of the plane of the strip, the lateral rows separated by alternately slit segments retained in the plane of the strip together defining nodes extending laterally across the strip.

7 Claims, 11 Drawing Sheets

185
182
142
132
149
185

ONE-STEP ROTARY FORMING OF UNIFORM EXPANDED MESH

BACKGROUND OF THE INVENTION (i) Field of the Invention

This invention relates to a method and apparatus for the production of expanded metal mesh sheet and, more particularly, relates to a one-step method and apparatus for the production of expanded metal mesh sheet for use in lead-acid battery manufacture.

(ii) Description of the Related Art

The prior art discloses rotary methods for expanding lead strip for use in the manufacture of battery plates. Such methods employ clusters of tools arranged sequentially for preforming and slitting the strip in a first step and completion of slitting of the strip in a second step. Sequential methods have the inherent problems of synchronization of steps, such as roll-to-roll synchronization, requiring certain registering and tracking considerations.

Sequential methods use different tooling for the different steps with the result that lead strip is not "symmetrically processed", in that opposite sides of the strip are not always subjected uniformly and simultaneously to the same pressures, forces, stretching, and the like. In one predominant method in the prior art, a three-shaft cluster of tooling is arranged sequentially with three different tooling devices, namely a "preformer", a "preform slitter" and a "slitter", such that a two-step method results. The preformer and preform slitter form the metal strip by stretching and cutting in a first step and the slitter completes the slitting in a second step.

Wires and nodes on opposite sides of the expanded strip produced by the stretching and forming according to the prior art are not uniform and are not symmetrical. The profile and shape on one side is not the mirror image of the other side resulting in a number of imperfections and defects. This becomes even more significant when higher elongation targets are desired in order to produce lighter grid electrodes for batteries.

Cominco U.S. Pat. No. 4,291,443 issued Sep. 29, 1981 and U.S. Pat. No. 4,315,356 issued Feb. 16, 1982, both included herein by reference, disclose the geometric relationship of conventional 3-shaft cluster tooling or spaced-apart roll pairs employing two sequential steps, i.e. preforming, wherein the lead strip is slit and stretched to form wires that are still solidly connected and not in a form to be pulled apart, and slitting, wherein alternate slits in the nodes are made to allow subsequent expansion to complete the process.

Cominco U.S. Pat. No. 4,297,866 issued Nov. 3, 1981, also incorporated herein by reference, discloses a sequential two-step process for the production of symmetrical slit wires deformed out of the plane of the strip having a trailing portion of the wire longer than the leading portion for improved stretchability of the wires.

Forming of the strip in a one-step process has been discounted and not achieved to date because of perceived intricacies of the grid design and physical limitations of the grid components, particularly fore-shortening and rippling of the strip. U.S. Pat. No. 1,472,769 issued Oct. 3, 1923 discloses a method and apparatus for expanding metal sheet between opposed rollers in which wire strands and bands are slit in the sheet, slit strands are returned to the plane of the sheet by flattening rolls, longitudinal corrugations are then formed in alternate series of bands in reverse directions to stretch the strands, and the sheet then laterally expanded to form a mesh. It was believed necessary to incorporate the flattening and longitudinal corrugating steps in the process for the formation of uniform meshes.

SUMMARY OF THE INVENTION

The present invention substantially overcomes the problems of the prior art and makes such one-step processing possible for the production of uniform mesh sheet particularly from ductile malleable metals such as lead and lead alloys. Uniform wire stretching, node formation and expanded mesh diamond geometry are achieved, according to the invention, in a rotary expander preferably employing cluster tooling. Wire elongation, previously limited to about 30%, can now be increased up to about 50% or more elongation for the production of light-weight batteries for use in the SLI (starting, lighting and ignition) battery industry.

A cluster tooling module utilizing one pair of opposing shafts containing identical combination former/slitter devices that slit and form all necessary grid wire components in a continuous motion is employed, resulting in no stripping or disengaging. A third tooling shaft simply adds centre and edge guiding features to the formed and slit material, for example by roll-forming the centre and perforating the edges. The resulting slit and formed lead material has uniformly stretched and shaped components on either side of the strip. The one-step method can be realized through rearrangement and retrofitting of existing tooling.

In its broad aspect, the method of the invention for forming expanded mesh sheet from a deformable strip comprises the steps of concurrently slitting and forming at least a portion of said strip contained within imperforate border portions to provide a plurality of longitudinally extending wire-like components, said components comprising elongated slit segments deformed out of the plane of the strip and alternately slit segments retained in the plane of the strip, said elongated slit segments being severed from laterally adjacent segments and said border portions and being substantially convexly shaped from the plane of the strip whereby slit segments in laterally adjacent components extend from opposite sides of the plane of the strip, and said alternately slit segments retained in the plane of the strip together define nodes extending laterally at least the width of said wire-like components across the said portion of the strip.

The apparatus of the invention for forming elongated alternately slit segments in deformable strip comprises a pair of opposed rolls each having a plurality of spaced discs having opposite side walls and circumferential, equally spaced, convexly shaped tool surfaces alternating with substantially flat surfaces, said discs having radial notches formed in the opposite sidewalls of alternate circumferential flat surfaces, whereby peripheral surfaces of opposing rolls are adapted to interact on deformable strip passing therebetween to slit and form convex segments and alternate nodes in said strip by intermeshing of said shaped tool surfaces.

The apparatus may additionally comprise a third roll having a substantially smooth peripheral surface in opposition to one of the pair of opposed rolls, whereby the third roll and a said first opposed roll are adapted to interact on deformed strip passing therebetween for roll forming the strip centre and perforating the strip edges to facilitate expansion.

DESCRIPTION OF THE PREFERRED EMBODIMENTS

Figure 1:
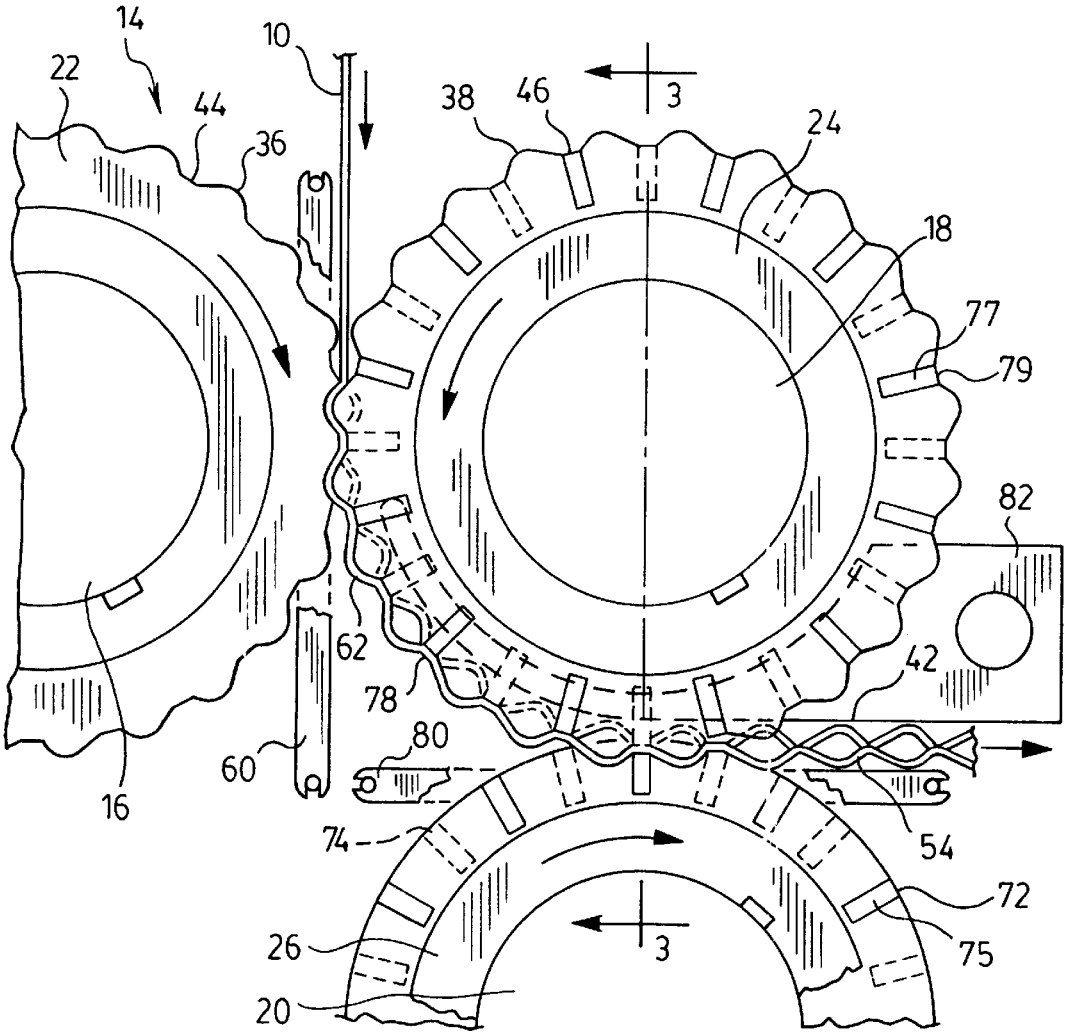
FIG. 1. (PRIOR ART)
FIG. 1 is a side elevation of a two-step slitting and preforming roll assembly of the prior art.

With reference first to the prior art apparatus depicted in FIG. 1, strip 10 enters vertically into slitting and preforming assembly 14 comprising a cluster of three rolls 16, 18 and 20, each roll having a plurality of spaced discs 22, 24 and 26 respectively. The discs have tooled peripheral edges. Moving strip is engaged successively between first and second rolls 16 and 18 and between second and third rolls 18 and 20. Rolls 16 and 18 act on rapidly advancing strip with substantially convexly shaped tool surfaces 36 of discs 22 engaging like tool surfaces 38 of discs 24 to slit portions 40 of strip 10 between bands 32 and to elongate slit segments 42 out of the plane of the strip, shown more clearly in FIG. 2. Tool surfaces 36 and 38 alternate with substantially flat portions 44 and 46 on their respective rolls and are equally spaced circumferentially to provide interacting peripheral surfaces as the rolls rotate. During rotation of the rolls, convexly shaped tool portions 36 of a disc 22 of first roll 16 are engaged by convexly shaped tool portions 38 of adjacent discs 24 of second roll 18 to provide longitudinal slits as the curved surfaces 36 penetrate through the plane of the strip to stretch slit segments 42 into spaces between adjacent discs 24 of second roll 18. The substantially flat portions 44 and 46 of the discs of both rolls then become circumferentially aligned and spaced from each other to hold unslit segments which together form laterally extending bands 32. In the same manner, convexly shaped tool portions 38 of a disc 24 of second roll 18 penetrate through the plane of the strip in the opposite direction to stretch slit segments 54 into spaces between adjacent first roll discs 22, on the opposite side of the plane of strip 10. In line with each disc 22 there is formed in the strip 10 slit segments 42 deformed out of the plane of the strip in one direction spaced by unslit segments retained in the plane of the strip. These components alternate with like components in line with each disc 24 and have slit segments 54 deformed out of the plane of the strip in the opposite direction. The unslit segments of all the components together define the continuous bands 32 extending across the strip 10 corresponding to the flat portions 44 and 46 of discs 22 and 24 respectively.

As the strip leaves the area of engagement of rolls 16 and 18, a set of stripper bars 60 assures separation of preformed strip from first roll 16. On being released from roll 16, preformed strip 62 follows second roll 18 for a convenient distance, e.g. a quarter turn as shown in FIG. 1, to an area of engagement of second roll 18 and opposed third roll 20 which has spaced discs 26 with disc components 74 consisting of effective cutting edges 72 and sidewall recesses 75. The cutting edges 72 and sidewall recesses 75 of discs 26 are spaced circumferentially to align, on alternate sides, on rotation of the rolls, with disc components 76 consisting of sidewall recesses 77 and cutting edges 79 in discs 24 of second roll 18 which extend circumferentially from alternate flat portions 46 to permit passage, without slitting, of alternate bands in each line of slits formed between adjacent components by engagement of the first and second rolls. Like sidewall recesses 75 or 77 occur in alternating positions in the opposite faces of the discs of both the second and third rolls. Cutting edges 72 of the disc peripheries penetrate through the strip to extend the slits through alternate bands 32 (FIG. 2) in a staggered relations thus completing two-step slitting, which permits lateral divergence of strip edges to form diamond-shaped meshes. Spacer discs 78 are placed between adjacent discs 22, 24 and 26 of the three rolls.

Figure 4:
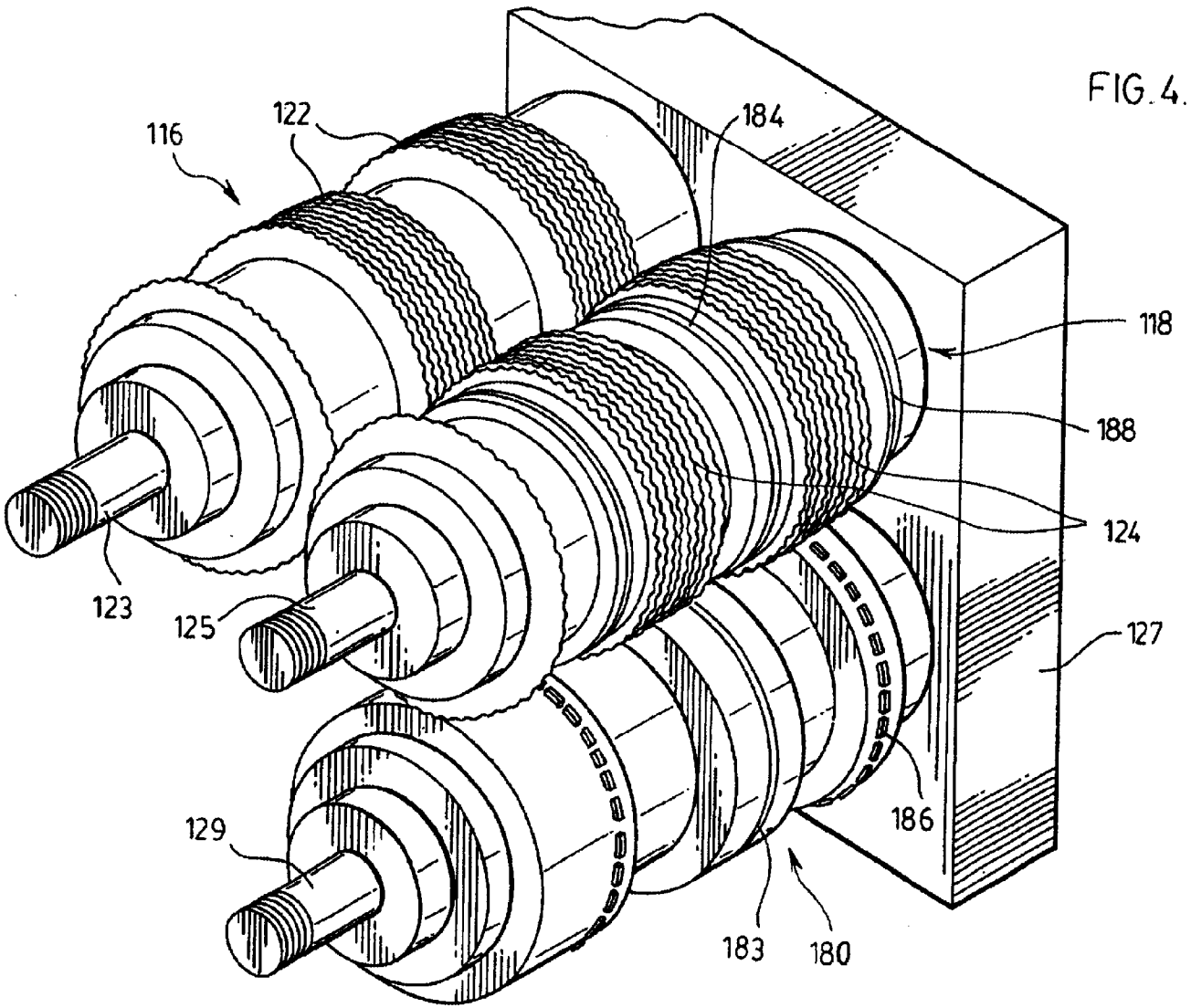
FIG. 4 is a perspective view of an exemplary one-step slitting and forming roll assembly of the present invention.
Figure 5:
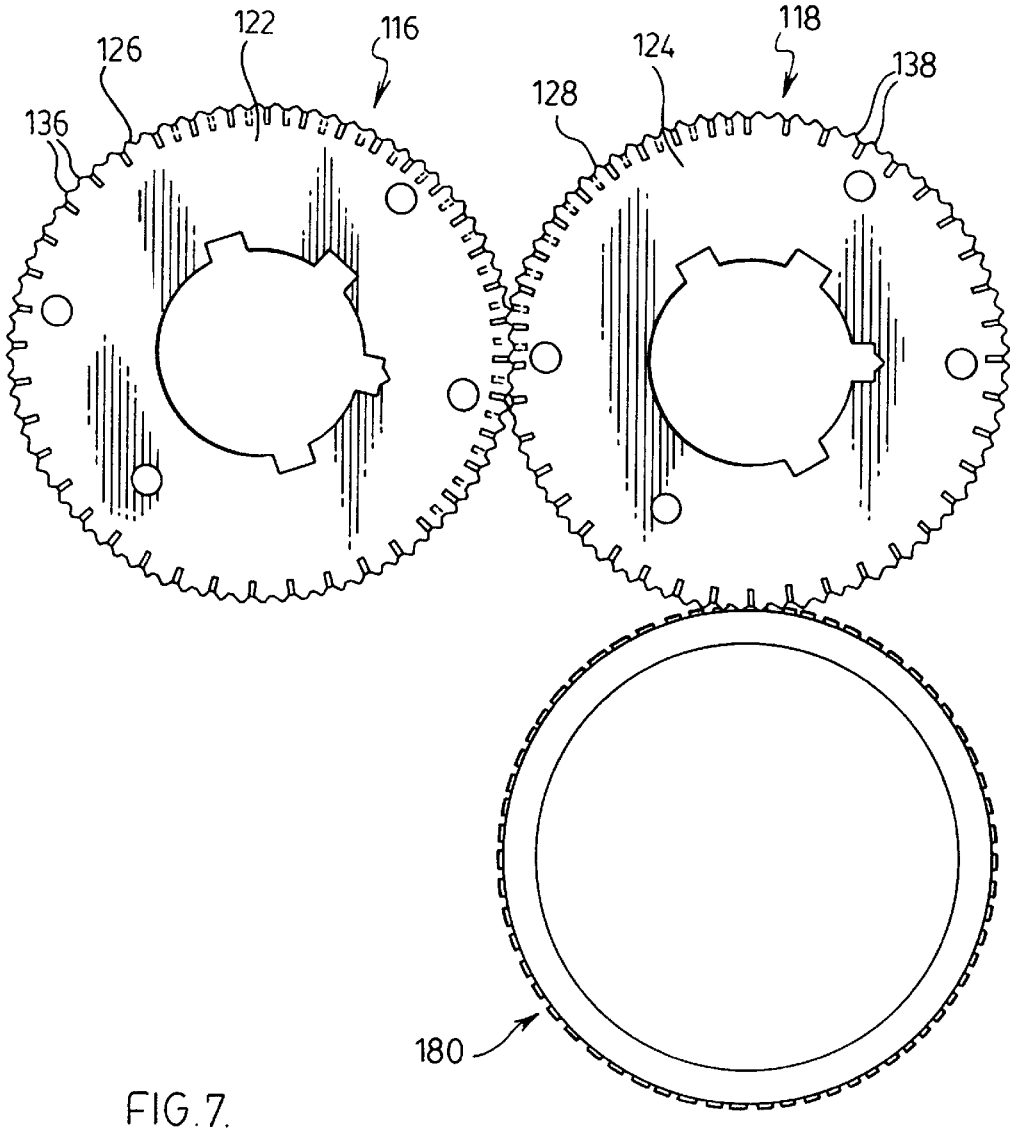
FIG. 5 is a side elevation of a pair of one-step slitting and forming rolls of the invention shown in FIG. 4.
Figure 7:
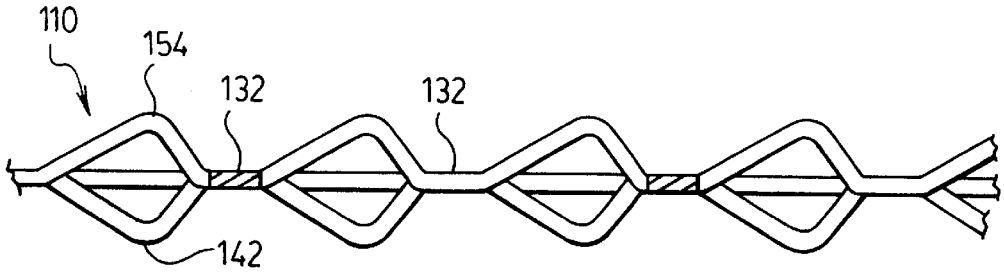
FIG. 7 is an enlarged side elevation, partly in section, of a slit and formed portion of a strip produced by the one-step method and apparatus of the invention shown in FIGS. 4, 5 and 6.
Figure 6:
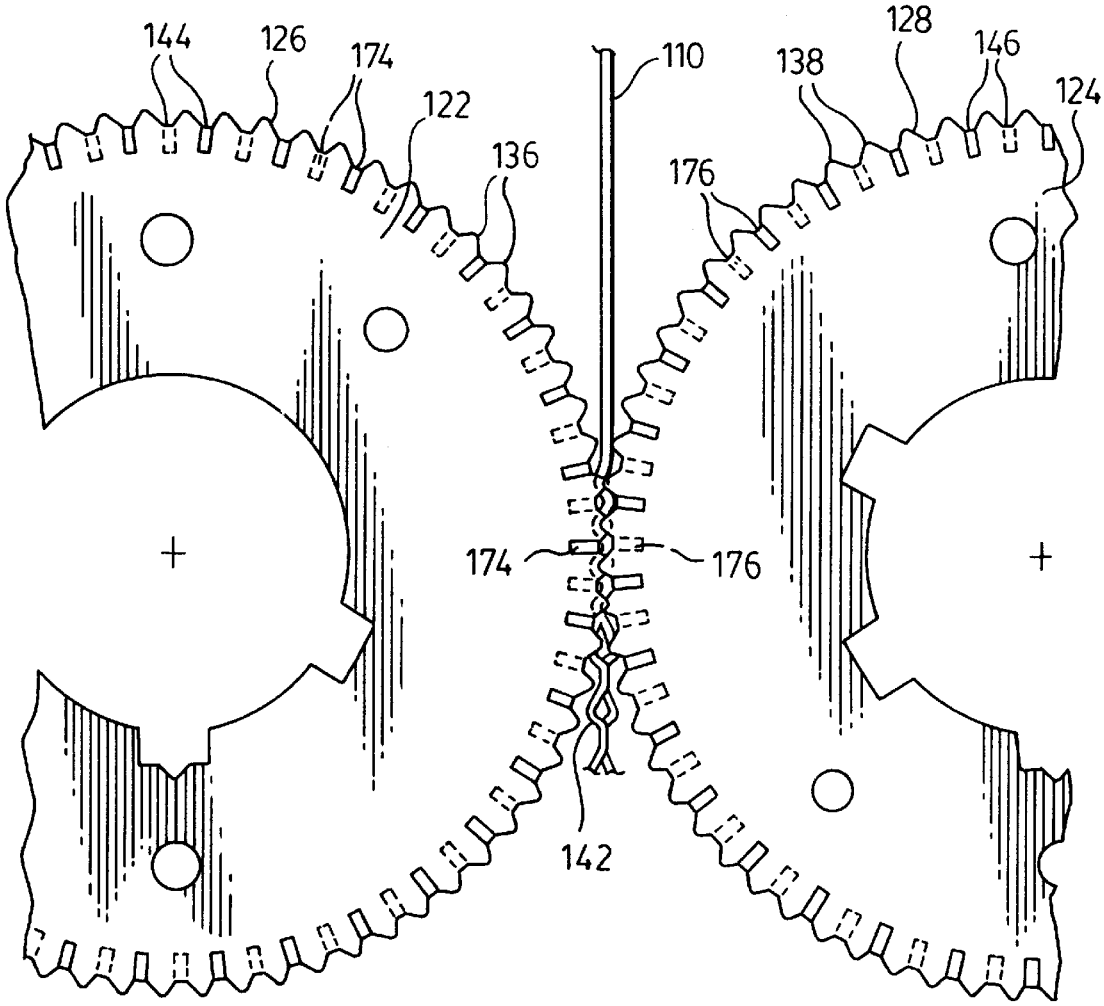
FIG. 6 is an enlarged side elevation of the slitting and forming roll assembly shown in FIG. 5 with a portion of fully slit and formed strip of the invention.

With reference now to FIGS. 4, 5 and 6, a pair of rolls 116, 118, each having a plurality of spaced discs 122, 124 mounted on shafts 123, 125 respectively, has identical tooled peripheral edges 126, 128. Shafts 123, 125 are journalled for rotation between a pair of spaced-apart sidewalls 127, one of which is shown for clarity of description. Peripheral edge 126 of each disc 122 has a convexly-shaped tool surface 136 adapted to mate with and engage an identical convex tool surface 138 of opposed adjacent discs 124 to slit a portion of strip 110 therebetween to deform and elongate transverse rows of convex slit segments 142 out of each side of the plane of the strip 110, as shown most clearly in FIGS. 6 and 7, between transverse bands 132, as has been described above with reference to transverse bands 32 in FIG. 2. Tool surfaces 136 and 138 alternate with substantially flat portions 144 and 146 on their respective discs and are spaced to provide interacting peripheral surfaces as the rolls rotate. Discs 122, 124 have radial notches 174, 176 formed in the opposite sidewalls of alternate circumferential flat portions 144, 146 in opposition to each other, as shown most clearly in FIG. 6.

Figure 8:
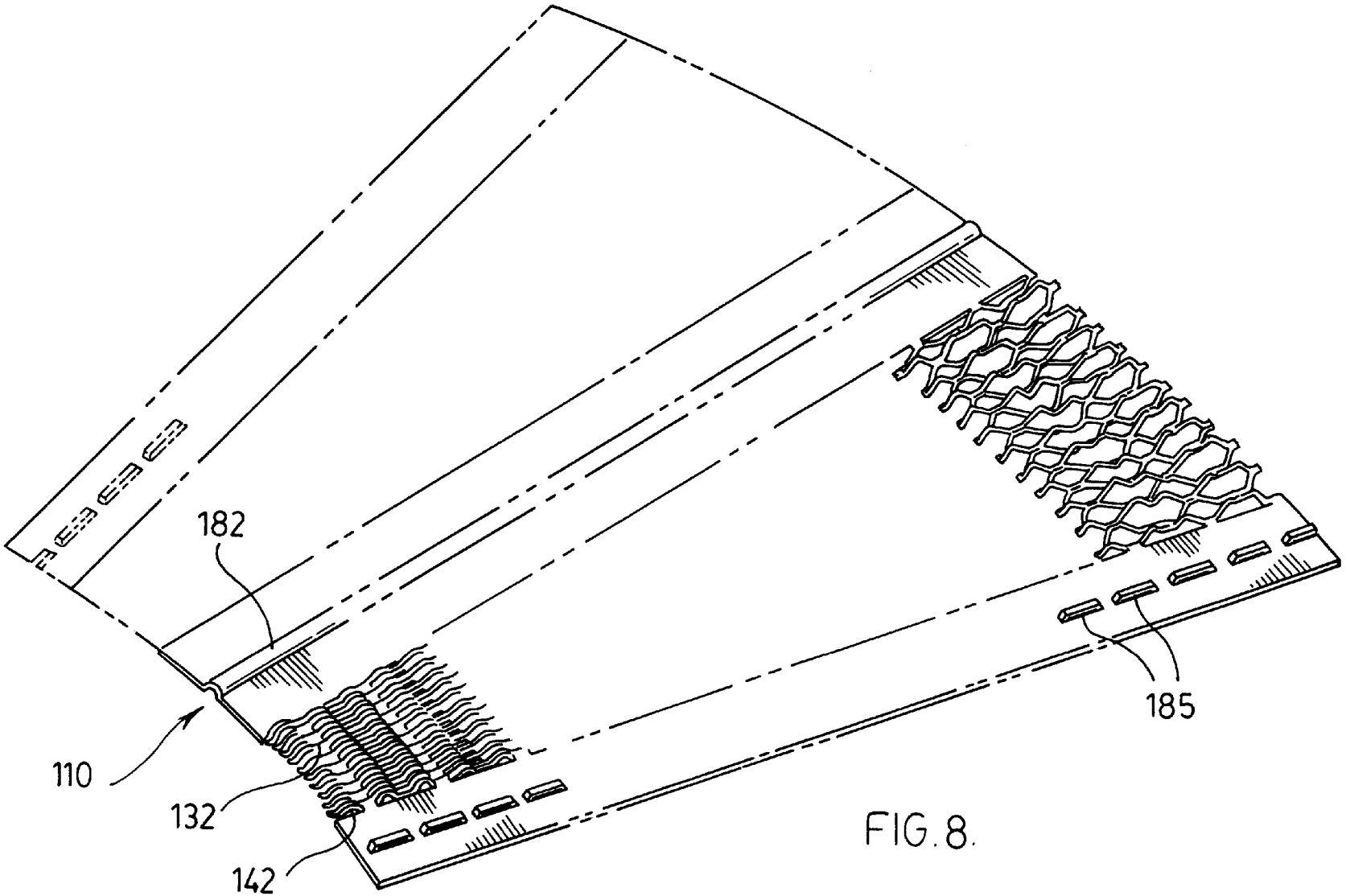
FIG. 8 is a perspective view of the strip shown in FIG. 7 in transition as it leaves the slitting and forming assembly of the invention to a subsequent lateral expansion.

During rotation of the rolls, convexly-shaped tool surfaces 136 of each discs 122 of roll 116 are engaged by like convexly-shaped tool surfaces 138 of adjacent discs 124 of opposed roll 118 to provide longitudinal slits as the curved surfaces penetrate through the plane of the strip for convexly-shaped tool surfaces 136 to stretch slit segments 142 between slits into spaces which are between adjacent discs provided by narrow-radius spacer discs, not shown. The substantially flat portions 144, 146 of the adjacent discs become circumferentially aligned transversely and spaced from each other to hold unslit segments which together form transverse bands 132, shown most clearly in FIGS. 7, 8 and 9. In like manner, convexly-shaped tool surfaces 138 of discs 124 stretch adjacent slit segments 154 into spaces between the adjacent discs on the opposite side of the plane of the strip.

Figure 9:
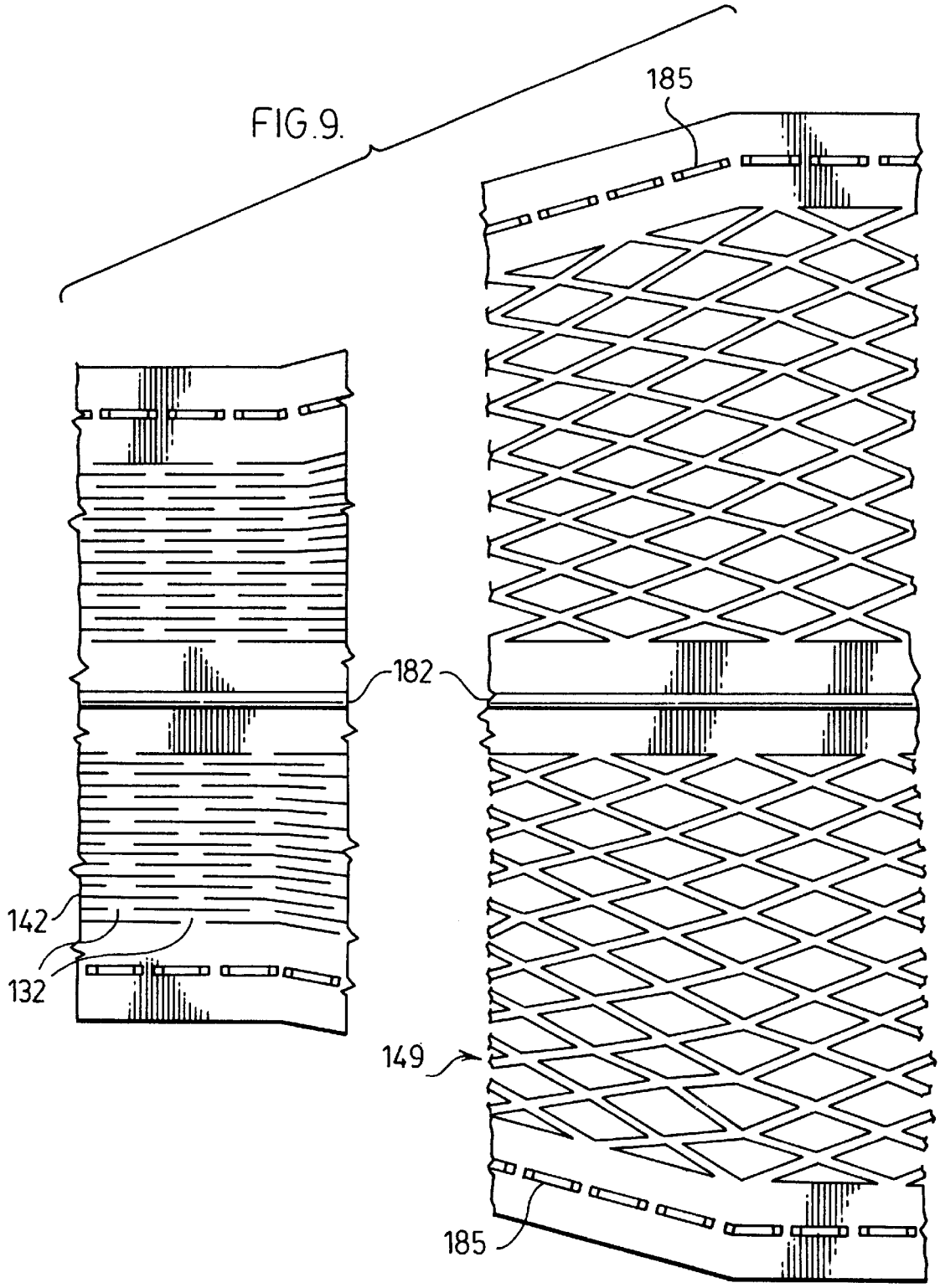
FIG. 9 is a plan view of portion of the strip, as shown in FIG. 8, showing transition from the single forming-slitting step to completion of lateral expansion prior to separation into battery plates.

Opposed alternating radial notches 174, 176 in adjacent disc sidewalls obviate slitting of adjacent flat portions 144, 146, as shown in FIG. 6 described above, whereas the absence of notches in every second flat portion 144, 146 causes the radially overlapping flat surfaces to shear and slit the strip therebetween. The slit pattern shown to the left as viewed in FIG. 9 is provided to the strip, allowing lateral expansion into the diamond-shaped mesh 149 as shown to the right as viewed in FIG. 9, such as by means of rotating expansion as described in detail in U.S. Pat. Nos. 4,291,443 and 4,315,356.

With particular reference to FIGS. 4 and 5, roll 180 is rotatably mounted for abutment against roll 118 rotating on shaft 129 to provide centre and edge guiding such as by roll-forming a longitudinal central rib 182 (FIGS. 8 and 9) by engagement of circumferential ridge 183 of roll 180 with mating circumferential recess 184 of roll 118 and perforating the side edges as designated by numeral 185 by engagement of equispaced circumferential protuberances 186 at each end of roll 180 with mating circumferential recesses 188 on roll 118 to facilitate edge gripping for subsequent lateral expansion into the finished mesh product. The ridge 183 and protruberances 186 with mating circumferential recesses may be reversed on the opposed rolls.

Figure 2:
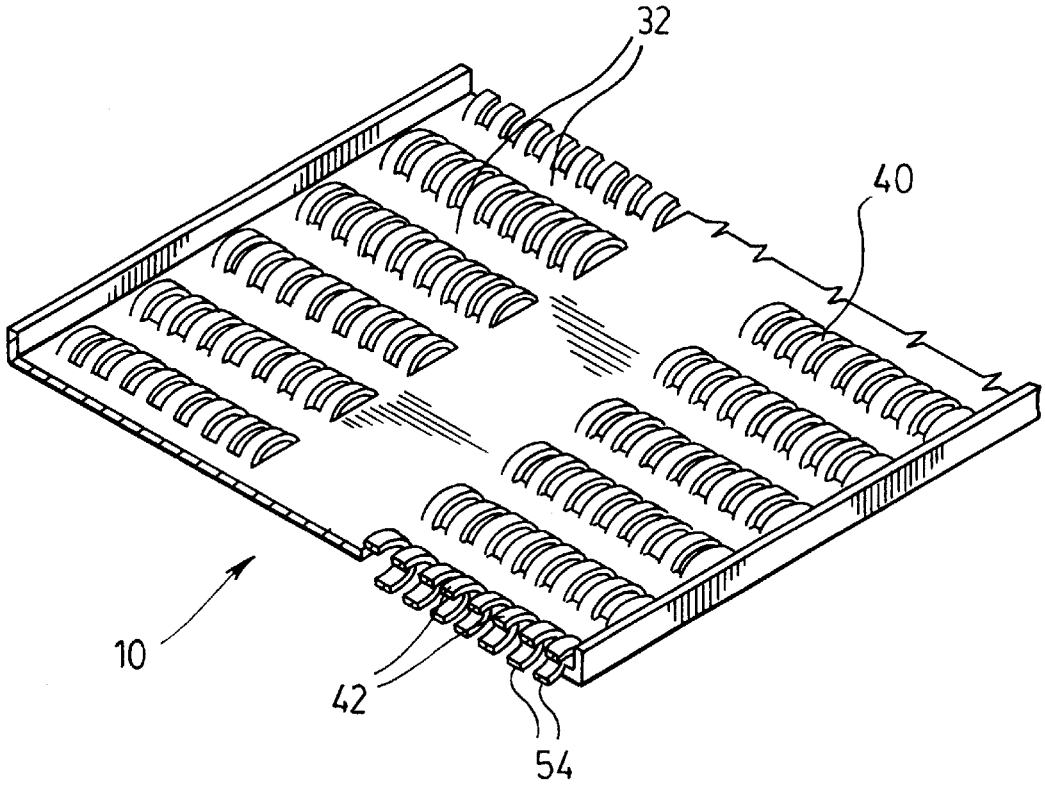
FIG. 2. (PRIOR ART)
FIG. 2 is a perspective view of prior art intermediary strip as produced by the first step of the prior art assembly of FIG. 1.
Figure 3:
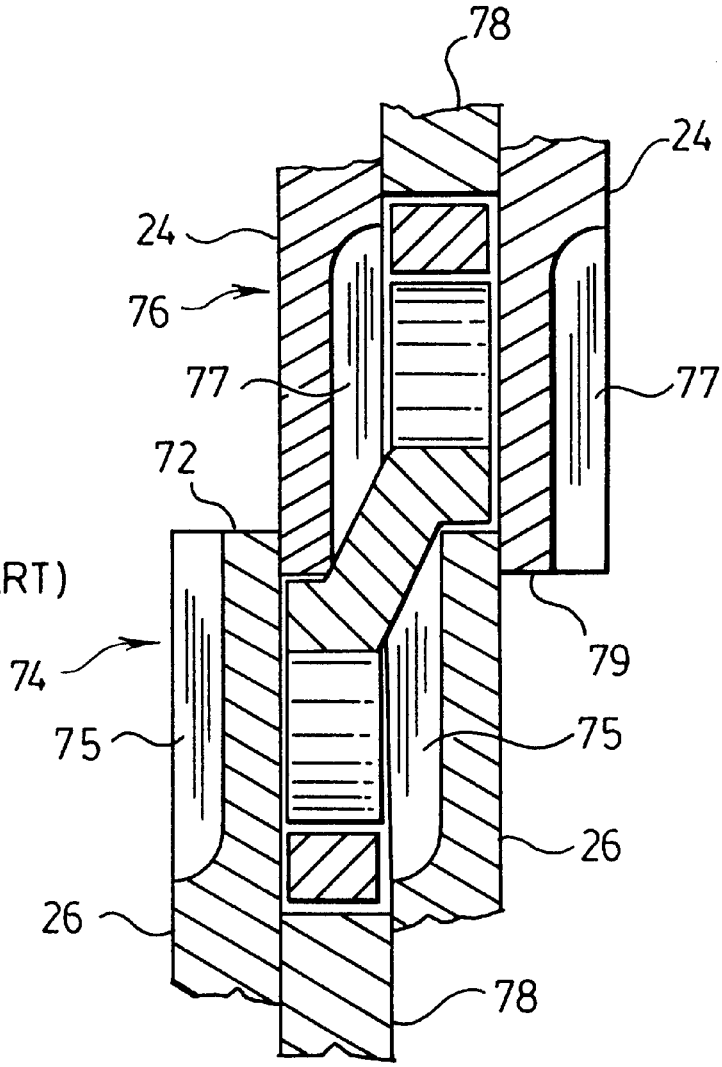
FIG. 3. (PRIOR ART)
FIG. 3 is an enlarged sectional view along line 3—3 of FIG. 1 showing enlargement of co-operating discs to complete alternate slitting of preformed strip.
Figure 10:
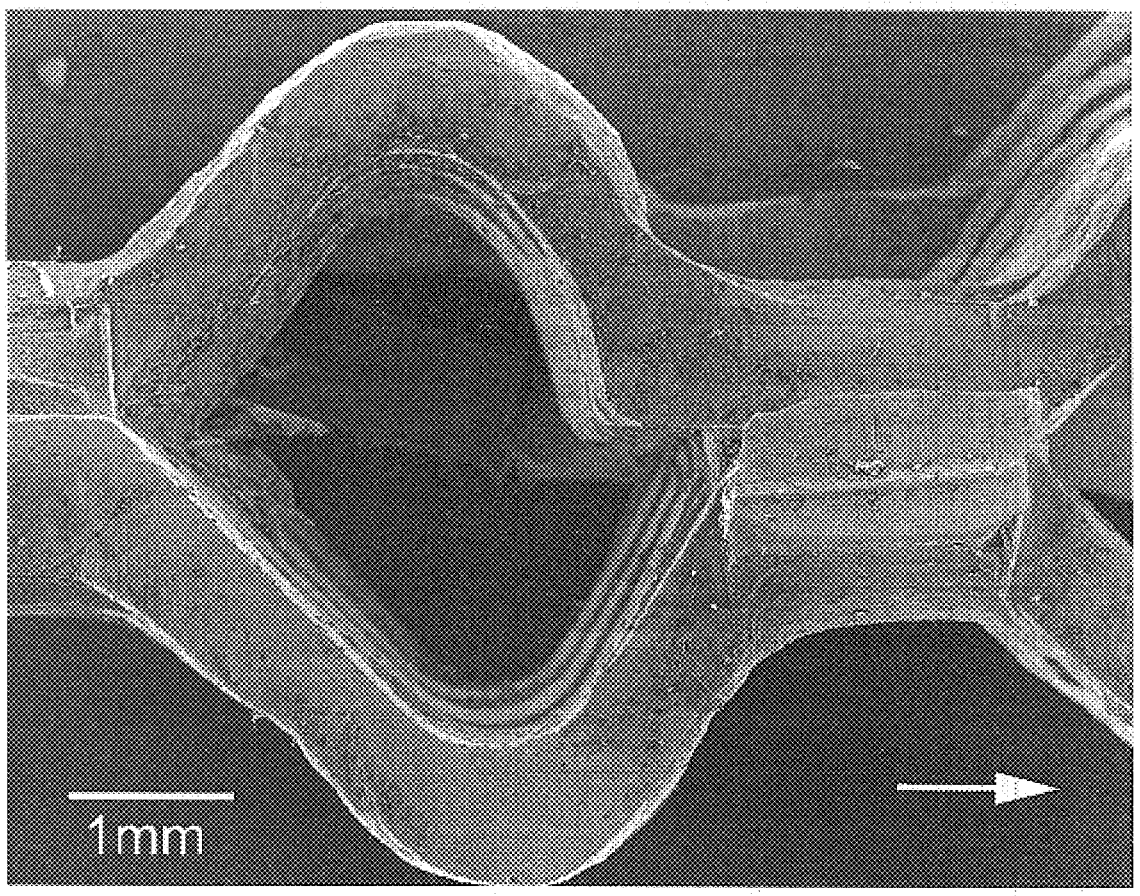
FIG. 10 is a photograph of an enlarged longitudinal section of a slit and formed portion of strip produced according to the prior art shown in FIGS. 1–3.

Turning to FIG. 10, an enlarged photograph of a longitudinal section of a slit and formed portion of strip produced according to the prior art illustrated in FIGS. 1–3 shows non-symmetry of wires and nodes on the upper part of the strip compared to the lower part of the strip. The preform slitters on second roll 18 give additional stretch, wire shaping and node forming to the opposite side of the strip, i.e. on the side of the strip adjacent third roll 20. The third roll 20, cooperating with roll 18 to slit the alternate nodes, does not add corresponding additional stretch, wire shaping and node forming to the opposite side of the strip, i.e. on the side of the strip adjacent second roll 18. With incomplete forming and stretching of elements on one side of the strip as shown in FIG. 10, for a 50% elongation, non-uniform stretching of the wires occurs resulting in fractures of the wires during subsequent expansion or premature corrosion failure during battery life.

Figure 11:
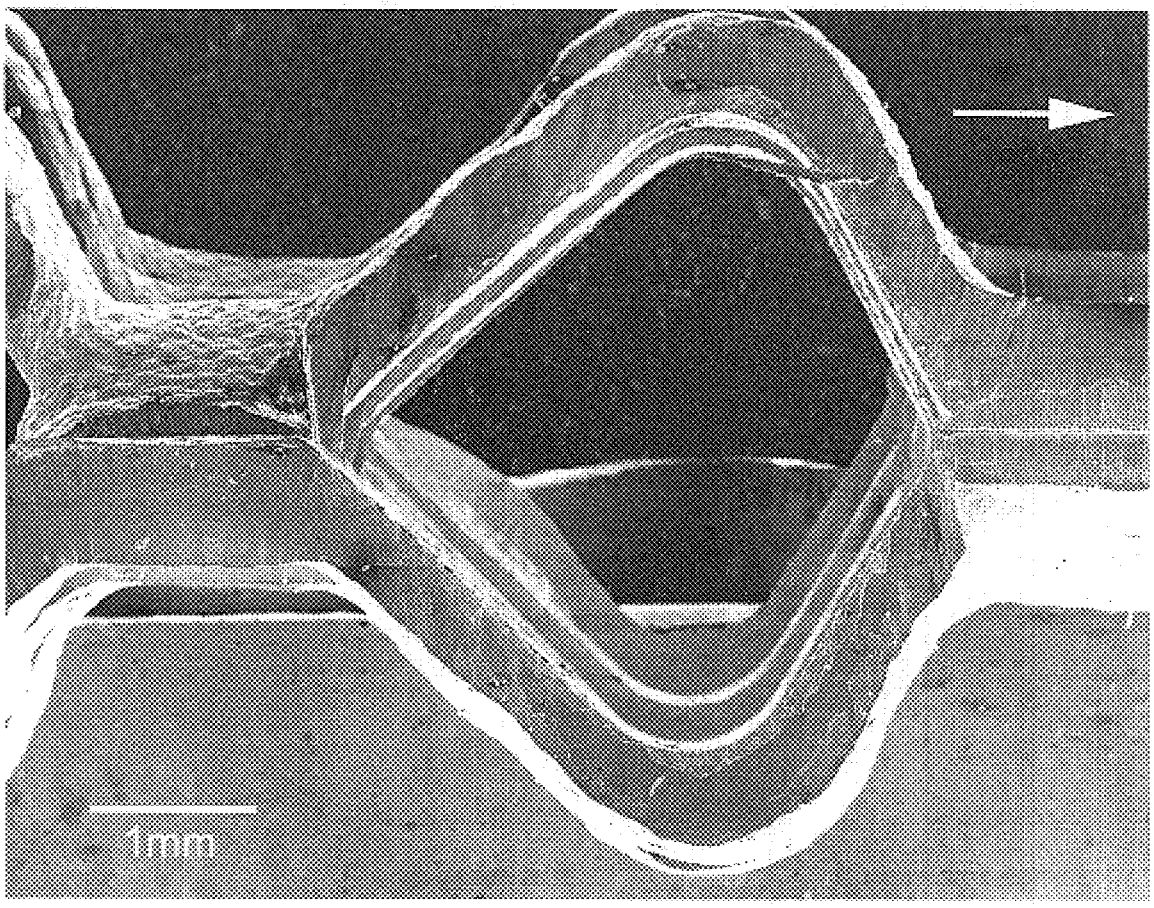
FIG. 11 is a photograph of an enlarged longitudinal section of a slit and formed portion of a strip according to the present invention.

With reference to FIG. 11, an enlarged photograph of a longitudinal section of a slit and formed portion of a strip produced according the present invention shows symmetrical wires and nodes on the upper and lower parts of the strip. The concurrent and uniform stretching and wire forming with completion of node slitting in the one-step operation of the invention permits elongation to a higher target of up to 50% or more of the wires. Uniformly stretched wires throughout the slit and formed strip to a length not heretofore possible allows expansion to a lighter mesh product with a minimum of wire fractures and metal stress.

It is desired to form wires in the shape of a lobe or rounded triangle having a triangle side ratio of leading arm to trailing arm, in the direction of travel, greater than 1:1 and preferably 1:1.3 to 1:1.5, to minimize undesirable trailing end thinning, as described in U.S. Pat. No. 4,297,866. The prior art strip of FIG. 10 has an arm ratio of leading arm to trailing arm of about 1:1 for the upper lobe, the upper lobe having less stretch than the lower lobe. The formed strip of the present invention shown in FIG. 11 has an arm ratio of leading arm to trailing arm for both upper and leading arm to trailing arm for both upper and lower lobes of about 1:1.3 with uniform stretch of both upper and lower wires for a 50% elongation.

Figure 12:
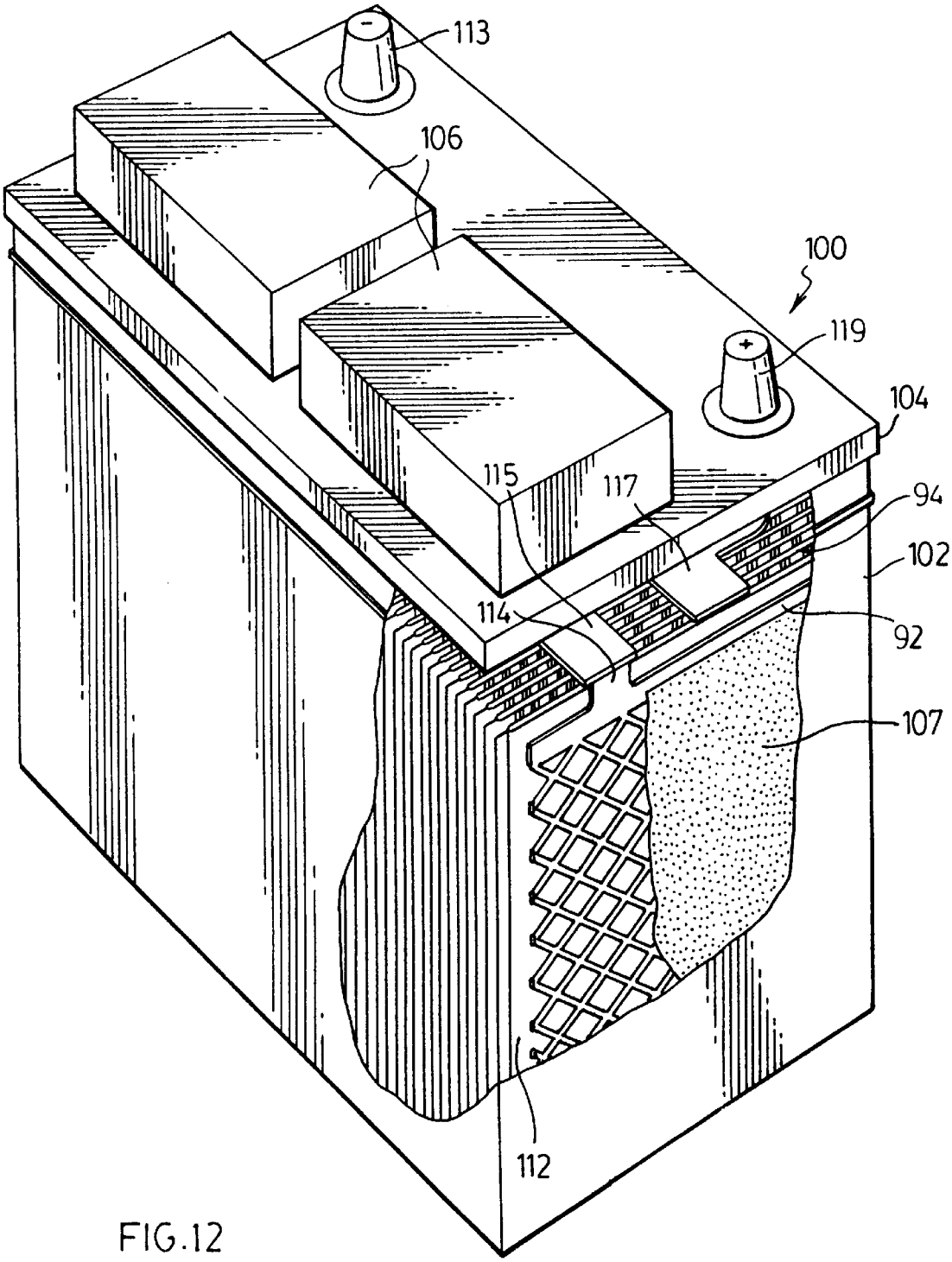
FIG. 12 is a perspective view, partly cut away, of a battery having battery plate grids produced from expanded strip of the invention.

FIG. 12 illustrates a battery 100 having a plastic casing 102 with cover 104 including vent covers 106 containing the battery electrode plates produced by the method of the invention. The plates including paste 107 are stacked vertically as negative plates 92 alternating with positive plates 94 separated from one another by plate separators 112. The grid tabs 114 of negative plates 92 are interconnected by metal leader 115 to negative battery post 113 and the grid tabs (not shown) of positive plates 94 are interconnected by metal header 117 to positive battery post 119. Sulphuric acid solution, not show, is added in an amount sufficient to submerge the battery plates for operating the battery.

It will be understood that other embodiments and examples of the invention will be readily apparent to a person skilled in the art, the scope of the invention being defined in the appended claims.

What is claimed is:

1. A one-step method of forming slit and preformed sheet for production of expanded mesh sheet from a deformable strip comprising the steps of concurrently slitting and forming at least a portion of said strip contained within border portions to provide a plurality of longitudinally extending wire-like components, said components comprising elongated slit segments deformed out of the plane of the strip and alternately slit segments retained in the plane of the strip, said elongated slit segments being severed from laterally adjacent segments and said border portions and being substantially convexly shaped from the plane of the strip whereby slit segments in laterally adjacent components extend from opposite sides of the plane of the strip, and said alternately slit segments retained in the plane of the strip together define nodes extending laterally at least the width of said one or more wire-like components across the said portion of the strip.

2. A method as claimed in claim 1 in which equispaced perforations are formed in opposite edge border portions of the strip.

3. A method as claimed in claim 2 in which the equispaced perforations are formed in a subsequent step.

4. A method as claimed in claim 2 additionally comprising expanding the slit and preformed sheet for production of expanded mesh sheet by rotary expansion.

5. A method as claimed in claim 1, in which the deformable strip is lead or lead alloy.

6. An expanded mesh sheet produced by the method of claim 4 in which the expanded mesh sheet is lead alloy for use as a battery electrode.

7. A lead acid battery having a plurality of battery electrodes as claimed in claim 6.

* * * * *